United States Patent [19]

Ivic

[11] 4,371,316

[45] Feb. 1, 1983

[54] CONTROL FOR A BILGE PUMP

[76] Inventor: Michael Ivic, P.O. Box 262, Seabrook, Tex. 77586

[21] Appl. No.: 246,652

[22] Filed: Mar. 23, 1981

[51] Int. Cl.[3] ..... F04B 49/04

[52] U.S. Cl. ..... 417/41; 200/84 R

[58] Field of Search ..... 137/412; 200/84 R; 417/40, 41; 73/308

[56] References Cited

U.S. PATENT DOCUMENTS 3,941,073 3/1976 Ridgeway ..... 417/40 X 4,001,533 1/1977 Conery ..... 200/84 C 4,215,975 8/1980 Niedermeyer ..... 417/40 X

*Primary Examiner*—Alan Cohan

[57] ABSTRACT

To commence and maintain the operation of a bilge pump until the bilge area is sufficiently evacuated of excess bilge water, an electrically conductive ball is deposited in spanning relation across, and thus closes, a pair of circuit switch contacts, and then rolls off said contacts when the permissible lower level is reached to terminate the pump operation. This operational mode is, of course, repeated when the bilge is again filled to excess.

3 Claims, 7 Drawing Figures

CONTROL FOR A BILGE PUMP

Figure 1:
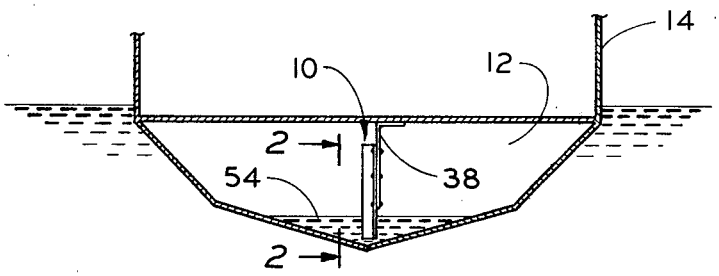

The present invention relates generally to a boat bilge pump control, and more particularly to a simply constructed, yet effective control for operating a bilge pump at an upper level of bilge water, and terminating the pumping operation thereof at a selected, permissible lower level.

To prevent damage to electrical components and other equipment of a boat that might be occasioned by the submersion thereof in excess bilge water, there are various controls for starting the pumping operation of a bilge pump whenever there is excess bilge water. As exemplified by prior U.S. Pat. No. 4,001,533, in a typical prior art control there is activated a magnetic switch at a "high" level which commences and maintains a bilge pump in operation until a desired "low" level is achieved, at which appropriate means are then effective to open the magnetic switch and terminate the operation of the bilge pump. Although seemingly simple, the "magnetic switch" control just referred to is subject to malfunction if the magnetic force does not close the switch in the first instance, or if the magnetic force is too great and resists subsequent opening and the pump thus continues to operate and run down the battery.

Broadly, it is an object of the present invention to provide an improved bilge pump control, devoid of any reliance on magnets or the like, overcoming the foregoing and other shortcomings of the prior art. Specifically, it is an object of the present invention to provide a circuit switch in a control circuit for a bilge pump that has positive opening and closing, and thereby provides effective control over the durations of operation and non-operation of the bilge pump.

A control circuit for a battery-operated bilge pump demonstrating objects and advantages of the present invention includes a normally open pair of contacts. Cooperating therewith is a float in the bilge operatively disposed to partake of ascending and descending movements in response to changes in the level of the volume of water existing in the bilge area. Functioning as the "switch arm" of the above referred to open pair of contacts is a ball of electrically conductive construction material having a first operative position in supported relation atop of the float and in practice, is carried to an elevated discharge station in response to ascending movement in the float occasioned by an increase in the volume of water in said bilge area, and which ball is then, at said discharge station, released into a passage means connected to cause movement of the ball from said discharge station to a second operative position in spanning relation across the normally open contacts so as to initiate pumping operation of the bilge pump and thus causing descending movement in the float. An upstanding extension on the float has a surface in position-holding contact with the ball during the descent of the float. Thus, the bilge pump is maintained in pumping operation for the duration of the contact between said surface and said ball, after which there is ball movement opening the switch contacts and terminating operation of the pump.

Figure 2:
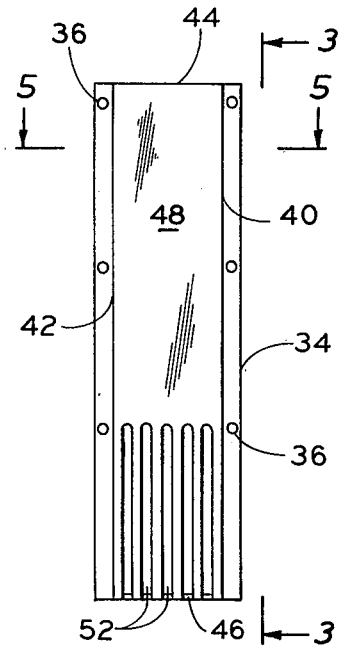
Figure 3:
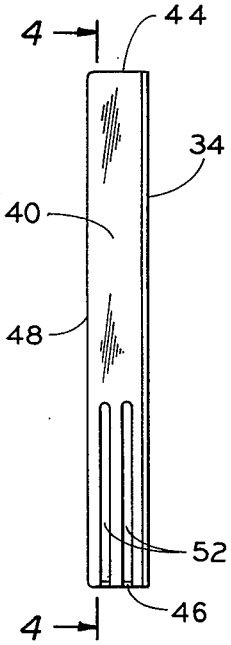
Figure 4:
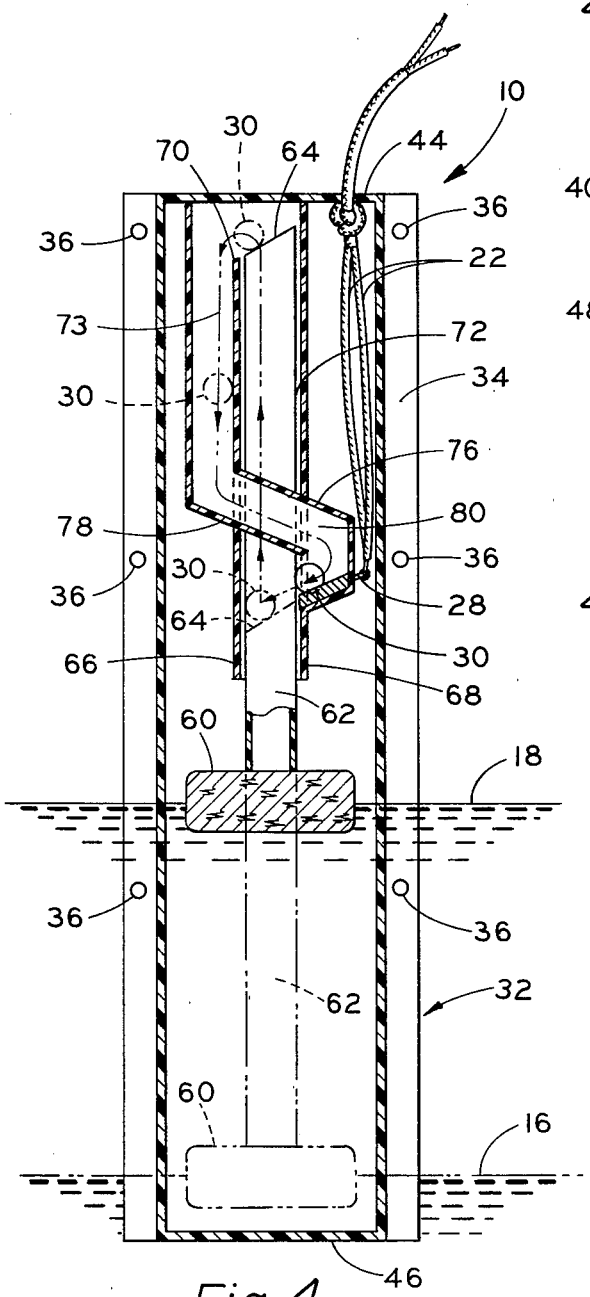
Figure 5:
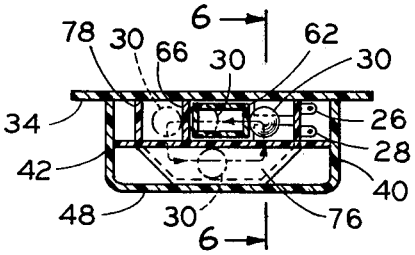
Figure 6:
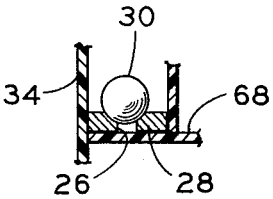
Figure 7:
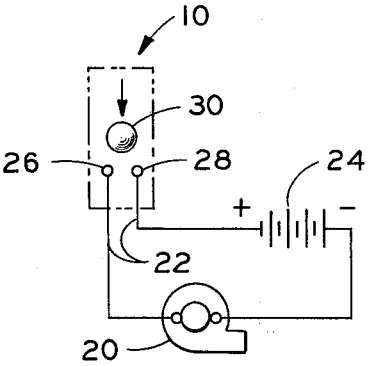

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a partial simplified front elevational view of a boat, and particularly the bilge area thereof, illustrating the location of the within inventive bilge pump control;

The remaining figures illustrate structural details and the operational mode of said bilge pump control. More particularly, FIG. 2 is a side elevational view, on an enlarged scale, of the housing of the bilge pump control as seen in the direction of the arrows 2—2 of FIG. 1;

FIG. 3 is a front elevational view of the bilge pump housing as seen in the direction of the arrows 3—3 of FIG. 2;

FIG. 4 is a side elevational view, on a still further enlarged scale, in section taken along line 4—4 of FIG. 3, illustrating the construction internally of the housing, in which positions of movement of a float component thereof are illustrated in phantom and in full line perspective, as is also the path of movement of another component of the control, which component is in the specific form of a ball;

FIG. 5 is a plan view of the within control, in section taken along line 5—5 of FIG. 2;

FIG. 6 is a partial sectional view as seen in the direction of the arrows 6—6 of FIG. 5 illustrating an operative position of the ball component in which it is in spanning relation across contacts of an electrical switch and thus in its operative position completing the electrical circuit through said switch; and FIG. 7 is a simplified electro-mechanical diagram illustrating the manner in which the within control commences and terminates the operation of a battery-operated bilge pump.

Before describing in detail the construction of the within inventive bilge pump control it is helpful to note firstly in connection with FIG. 1 that said control, generally designated 10, is operatively disposed in a bilge area 12 of a boat 14 for the purpose, as best illustrated in FIG. 4, of sensing when a low level of water 16 existing in the bilge area increases to that extent that the level thereof reaches the elevated height 18, at which time the control is required to commence the operation of a bilge pump 20 (see FIG. 7) which pumps out the excess bilge water to again restore the volume thereof to the permissible lower level 16. Still referring to FIG. 7, it will be understood that the bilge pump 20 is powered by a motor operated by a battery, and is thus electrically connected by conductors 22 to a battery source 24. Included as part of the circuit 22 is a normally open pair of electrical contacts 26 and 28, all as is clearly diagrammatically illustrated in FIG. 7. In accordance with the present invention, the within inventive control contemplates use of a component in the specific form of a ball 30 which is further characterized by being fabricated of electrically conductive material. In accordance with the operational mode of the within control, which will be explained in greater detail subsequently, ball 30 has one operative position in which it is in a clearance position in relation to the open contacts 26 and 28 during which, of course, the circuit 22 is not completed and therefore the bilge pump 20 is not operative. The other operative position for the ball 30 in accordance with the present invention is one in which it is deposited in spanning relation across the contacts 26 and 28, in which position of course circuit 22 is completed and the bilge pump 20 is then operated by the battery 24. A notheworthy feature of the within control is that the ball 30 is held in its said operative position closing switch 26, 28 for a selected duration of time appropriate to achieve via the pumping action of the bilge pump 20 a reduction or diminishment of the water in the bilge pump area which results in the lowering of the high level 18 thereof to the permissible lower level 16.

With the above understanding of the operational mode of the within inventive bilge pump control 10 hereof, reference should now be made particularly to FIGS. 2–6 illustrating details of a preferred construction thereof. Control 10 includes a generally rectangular housing 32 of non-corrosive construction material such as plastic or the like. The rear wall 34 of the housing has opposite peripheral edges with spaced openings, individually and collectively designated 36, to be used for bolts or the like in attaching the housing 32 to a support member 38, as illustrated in FIG. 1. Appropriately attached to the back wall 34 are opposite side walls 40 and 42 and top and bottom walls 44 and 46 which cooperate with a front panel or wall 48 to bound a float compartment 50. Slots, individually and collectively designated 52, in the side and front walls of housing 32 provide communication into the chamber 50 for any volume of bilge water 54 which exists in the bilge area 12.

Disposed for ascending or descending movement along with the changing levels 16, 18 of the bilge water is a float 60 fabricated of an appropriate buoyant material. Appropriately attached as an upstanding extension to float 60 is a hollow upright member 62 having an angularly inclined upper surface 64, the function of which will soon be apparent. Upright 62 is confined to a designated vertical path of movement between vertically oriented walls 66 and 68. Thus, in the lowermost position of the float 60 as depicted in FIG. 4, upright 62 will be understood to be in the position illustrated in phantom perspective in FIG. 4, in which the inclined surface 64 is at the level indicated and in which, more importantly, the electrically conductive ball 30 is in position on surface 64 also as illustrated in phantom perspective in FIG. 4. If it is next assumed that the water level rises from the level 16 towards and eventually up to the level 18, the resulting ascending movement in the float 60 will correspondingly result in the upright member 62 carrying the ball 30 to the uppermost or elevated position as illustrated in full line in FIG. 4. In said position, ball 30 is carried above and thus clear of the upper edge 68 of wall 66, said edge defining what can be aptly termed a discharge station. In the conditions depicted, ball 30 rolls down the incline of surface 64 and will be understood to be directed through a passage, soon to be described, and thus along a path 73 to its previously noted operative position in which it is in spanning relation across the circuit open contacts 26 and 28. The just referred to operative position of the ball 30 is specifically shown in FIG. 6.

As has already been noted in the FIG. 6 operative position of the ball 30, circuit 22 is completed and battery 24 thus energizes the bilge pump 20 and commences the pumping operation thereof. As a result, the bilge pump evacuates the volume of water 54 in the bilge area 12 and thus is effective in reducing the level thereof from the height 18 to the permissible height 16. During this time the float 60 partakes of descending movement in the compartment 50. It is important to note that while the float is descending so, of course, is the upright 62, and most important, the surface or wall 72 of upright 62 is during this descending movement in contact with the ball 30 and is thereby effective in holding the ball in its contact-closing position of FIG. 6. It is only when the float 60 reaches the lower level 16 that the upright 62, or more particularly the upper surface 64 thereof, descends below and thus clears the inclined contacts 26, 28. As a result, the ball 30 goes onto the inclined surface 64 and thus off of the contacts 26, 28, thereby opening the electrical switch and terminating the operation of the bilge pump 20.

Also, as should be readily apparent from FIG. 4, ball 30 is held by the inclination of surface 64 during the ascent of float 60 in a clearance position in relation to the contacts 26 and 28 so that even assuming that there is a rocking movement of the vessel or boat 14, there is a significant probability that the bilge pump 20 will not operate intermittently, or otherwise than as above described.

From the preceding description it should be readily apparent that by proper selection of the size of the upright 62 and the location of the discharge station 70 that any desired duration of pumping operation of the bilge pump 20 can be achieved, and that this in turn provides control over the upper level 18 at which the bilge pump commences its operation and the lower level 16 at which this operation is terminated.

Any suitable manner of directing the ball 30 during its descent along the path 73 from the discharge station 70 into its operative switch-closing position of FIG. 6 is satisfactory for purposes of the within invention. The preferred means includes using an operative arrangement of walls defining an appropriately curving passageway which follows the path 73, said walls being more particularly discernible in FIGS. 4 and 5. These walls include a vertically oriented wall length 74 which cooperates with a co-extensive length of the previously noted walls 66, said walls opening into a somewhat encircling arrangement of walls 76 and 78 which terminates in a discharge opening 80 which is slightly above and in facing relation to the open pair of switch contacts 26 and 28. In this manner, the ball 30 which descends along the path 73 is delivered to the discharge opening 80 and is deposited in spanning relation closing the contacts 26 and 28, all as already described. In lieu of walls defining a passageway, as just described, a hose also can be connected from the discharge station 70 to an appropriate strategic position in relation to the contacts 26 and 28 for discharging the ball 30 onto these contacts. In other respects as well, it will be understood that a latitude of modification, change and substitution is intended in the foregoing disclosure and that in some instances some features of the invention will be employed without a corresponding use of other features. Accordingly, it is appropriate that the appended claims be construed broadly and in a manner consistent with the spirit and scope of the invention herein.

What is claimed is:

1. A control for selectively operating a bilge pump for a boat comprising a float operatively disposed in a bilge area of a boat so as to partake of ascending and descending movements in response to changes in the level of the volume of water existing in said bilge area, an electrically energized motor-operated bilge pump having an electrical circuit with a normally open pair of contacts, a ball of electrically conductive construction material having a first operative position in supported relation atop of said float incident to said ball being carried to an elevated discharge station in response to ascending movement in said float occasioned by an increase in the volume of water in said bilge area, a passage means connected to cause movement of said ball from said discharge station to a second operative position in spanning relation across said normally open contacts so as to initiate pumping operation of said bilge pump and descending movement in said float, and an upstanding extension on said float having a surface in position-holding contact with said ball during said descent of said float, whereby said bilge pump is maintained in pumping operation for the duration of said contact between said surface and said ball after which there is ball movement from said second to said first operative position thereof terminating operation of said pump.

2. A bilge pump control as claimed in claim 1 wherein the elevated location of said discharge station is selected to be above said normally open contacts for an extent effective to provide any desired duration of bilge pump operation.

3. A bilge pump control as claimed in claim 2 wherein said passage means is comprised of walls bounding a through passage having an upper opening therein for receiving said ball at said discharge station and a lower opening in facing relation to said contacts for discharging said ball into spanning relation thereacross.

* * * * *